US010143313B1

(12) United States Patent
Hunter

(10) Patent No.: US 10,143,313 B1
(45) Date of Patent: Dec. 4, 2018

(54) BLANKET LIFTING APPARATUS

(71) Applicant: Bryan A. Hunter, Camdenton, MO (US)

(72) Inventor: Bryan A. Hunter, Camdenton, MO (US)

( * ) Notice: Subject to any disclaimer, the term of this patent is extended or adjusted under 35 U.S.C. 154(b) by 0 days.

(21) Appl. No.: 15/875,062

(22) Filed: Jan. 19, 2018

(51) Int. Cl.

| | |
|---|---|
| ***A47C 21/02*** | (2006.01) |
| ***A47C 31/00*** | (2006.01) |
| ***A47C 21/00*** | (2006.01) |
| ***A47C 21/04*** | (2006.01) |

(52) U.S. Cl.
CPC ..... *A47C 21/024* (2013.01); *A47C 21/006* (2013.01); *A47C 21/044* (2013.01); *A47C 21/048* (2013.01); *A47C 31/00* (2013.01)

(58) Field of Classification Search
CPC ..... A47C 21/00; A47C 21/02; A47C 21/022; A47C 21/024; A47C 21/028; A47C 19/022; A47C 31/00
USPC ..... 5/505.1, 504.1, 503.1, 658, 53.1, 51.1
See application file for complete search history.

(56) References Cited

U.S. PATENT DOCUMENTS

| | | | | |
|---|---|---|---|---|
| 3,713,182 | A | 1/1973 | McNeal | |
| 4,644,599 | A * | 2/1987 | Wolcott | A47C 21/02 |
| 5,881,406 | A | 3/1999 | Cobb | |
| 7,231,680 | B1 * | 6/2007 | Hafford et al. | A47C 21/02 |
| 7,679,888 | B2 * | 3/2010 | Kirschner et al. | G06F 1/16 |
| 7,864,512 | B2 * | 1/2011 | Kirschner et al. | G06F 1/16 |
| 7,874,029 | B2 | 1/2011 | Alston | |
| 7,996,938 | B1 * | 8/2011 | Calmes et al. | A47C 21/00 |
| 8,272,086 | B1 * | 9/2012 | Calmes et al. | A47C 21/00 |
| 2002/0101139 | A1 * | 8/2002 | Lee | A47B 21/00 |
| 2008/0165481 | A1 * | 7/2008 | Kirschner et al. | H05K 7/16 |
| 2008/0295247 | A1 | 12/2008 | Rogers | |
| 2009/0056019 | A1 * | 3/2009 | Alston | A47C 21/02 |
| 2010/0172075 | A1 * | 7/2010 | Kirschner et al. | H05K 5/00 |

* cited by examiner

*Primary Examiner* — Robert G Santos
(74) *Attorney, Agent, or Firm* — Dale J. Ream

(57) ABSTRACT

A blanket lifting apparatus for raising bedding above the feet of a person lying on a bed includes a threaded rod rotatably coupled to a bottom wall of a framework, the rod extending upwardly to an opposed distal end. A primary lift panel is operatively coupled to the rod and moved vertically when the rod is actuated to rotate. Spring clips are mounted to a top wall of the primary lift panel for selectively retaining the bedding such that the bedding is moved vertically according to movement of the primary lift panel. An auxiliary lift panel is pivotally coupled to the top wall, the auxiliary lift panel being movable between a stowed configuration generally parallel to the primary lift panel and a deployed configuration extending away from the primary lift panel in the direction of the bed.

24 Claims, 14 Drawing Sheets

BLANKET LIFTING APPARATUS

BACKGROUND OF THE INVENTION

This invention relates generally to sheet and cover lifting devices and, more particularly, to a blanket lifting apparatus that raises an upstanding panel situated between a bed mattress and footboard with a motorized threaded rod so as to provide relief to the legs and feet of a person lying in the bed.

Although difficult to explain medically, many people experience significant discomfort in their legs, feet, and toes as a result of the weight of blankets and sheets on a bed. More particularly, a person lying in a bed may find it more desirable to leave their lower extremities uncovered to avoid this uncomfortable or even painful circumstance. Unfortunately, the equally uncomfortable condition of one's feet getting cold usually leads to leaving the blankets over the feet.

Various devices have been proposed in the art for raising the blankets of a bed. Although presumably effective for their intended purposes, the existing devices do not provide a combination of a primary upstanding panel and an auxiliary lift panel (i.e. a "flap") that securely raises blankets lying on a bed via a remote control device along with heating and massage modules for the comfort of a person lying in the bed. Further, the existing devices do not provide a simple solution of a threaded rod and sleeve bearing for controlling vertical movement of the primary lifting panel or the safety feature of a collapsible casing that prevents injury in the instance that a user inadvertently falls and lands atop the vertical rod.

Therefore, it would be desirable to have a blanket lifting apparatus that overcomes the limitations of the prior art identified above.

SUMMARY OF THE INVENTION

A blanket lifting apparatus according to the present invention for raising bedding that is lying atop a mattress of a bed such that the bedding is raised above the feet of a person lying on the mattress includes a threaded rod having a proximal end rotatably coupled to a bottom wall of a framework, the rod extending upwardly from the bottom wall to an opposed distal end. A primary lift panel is operatively coupled to the rod such that the primary lift panel is moved vertically when the rod is actuated to rotate in a first or second direction, respectively. A plurality of spring clips is mounted to a top wall of the primary lift panel for selectively retaining the bedding such that the bedding is moved vertically according to movement of the primary lift panel. An auxiliary lift panel is pivotally coupled to opposed ends of the top wall, the auxiliary lift panel being movable between a stowed configuration generally parallel to the primary lift panel and a deployed configuration extending away from the primary lift panel in the direction of the bed.

Therefore, a general object of this invention is to provide a blanket lifting apparatus for selectively raising the blankets adjacent the footboard of a bed so as to alleviate pressure on a person's feet while lying in bed.

Another object of this invention is to provide a blanket lifting apparatus, as aforesaid, having heat and foot massage elements for customizing a person's comfort while sleeping.

Still another object of this invention is to provide a blanket lifting apparatus, as aforesaid, that raises or lowers a primary lift panel using a threaded thumb screw rod.

Yet another object of this invention is to provide a blanket lifting apparatus, as aforesaid, having an auxiliary lifting panel or flap to enhance the lifting of a blanket on a bed.

A particular object of this invention is to provide a blanket lifting apparatus, as aforesaid, having a collapse casing surrounding the rod that is configured to immediately collapse the rod upon detection that a person has inadvertently fallen atop the rod or primary lift panel.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
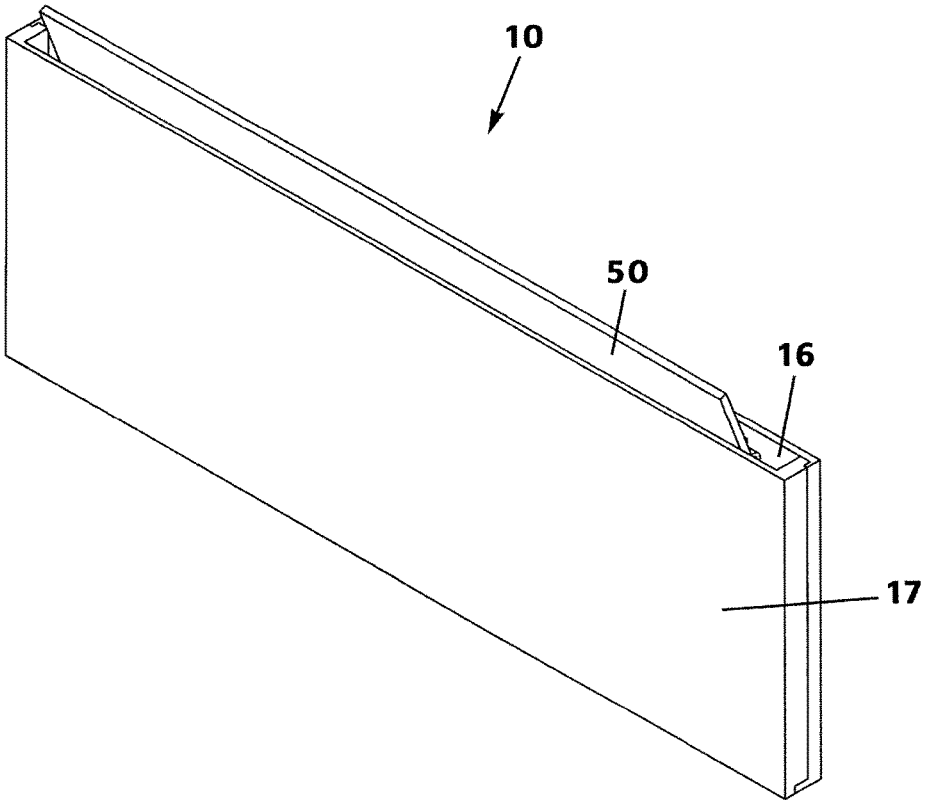
FIG. 1 is a perspective view of a bedding lifting apparatus according to a preferred embodiment of the present invention, illustrated with a primary lift panel in a lowered configuration.

A blanket lifting apparatus according to a preferred embodiment of the present invention will now be described in detail with reference to FIGS. 1 to 10 of the accompanying drawings. The blanket lifting apparatus 10 includes a threaded rod 30, a primary lift panel 20, an auxiliary lift panel 50, a sleeve bearing 40, a heating element 60, a foot massaging device 64, and a collapse casing 70.

The blanket lifting apparatus 10 includes a framework 12 configured for attachment to a bed frame (not shown) and positioned between a bed's mattress and a footboard (not shown). The framework 12 includes a bottom wall 14 having a linear and elongate configuration. The bottom wall 14 has a short width from which a primary lift panel 20 and back panel 16 extend upwardly. The primary lift panel 20 and back panel 16 are spaced apart so as to define an interior space therebetween and have general planar configurations.

The primary lift panel 20 includes an exterior wall 22 closest to the mattress of the bed (not) shown and an interior wall 24 closest to the back panel 16 of the framework 12, the interior and exterior walls being parallel and spaced apart and defining an interior space therebetween. The primary lift panel 20 may define an open bottom or at least one or more air inlet 27 openings through which fresh air may be drawn upwardly into an interior space defined by the primary lift panel 20 as will be described further below. It is understood that this area may be hollow or may include channel structures for directing air flow. In addition, an air filter (not shown) may be situated in this or another space so as to purify air being drawn in and distributed as described below.

A rod 30 having a cylindrical configuration has a proximal end 32 operatively coupled or mounted to the bottom wall 14 and extends upwardly therefrom to a distal end 34 opposite the proximal end 32. The rod 30 has an outwardly threaded configuration. A motor 36 is operatively coupled to the proximal end 32 of the rod 30 and is intermediate the proximal end 32 and the bottom wall 14. The motor 36 may also be referred to as the rod motor, primary motor, or a stepper motor 36. The motor 36 causes the rod 30 to rotate in either a clockwise (i.e. a "first direction") or counter-clockwise (i.e. a "second direction").direction when energized to as to raise or lower the primary lift panel 20 vertically as will be discussed below in more detail. The motor 36 may be energized by its electrical connection to a battery or AC power, i.e. the power source 90. Further, the blanket lifting apparatus 10 may be operated by a user via an input device such as a remote control device 92.

The primary lift panel 20 is operatively coupled to the rod 30 so as to be raised or lowered as the rod 30 is rotated. It is understood that the rod 30 extends upwardly through the interior space of the primary lift panel 20 and is coupled thereto. The primary lift panel 20 is positioned parallel to the back panel 16 and perpendicular to the bottom wall 14 of the framework 12 but is not actually coupled to or in contact with either one. More particularly, the blanket lifting apparatus 10 includes a sleeve bearing 40 having a tubular or cylindrical configuration that defines a hollow interior. An interior surface of the sleeve bearing 40 has a threaded configuration that is complementary to and engaged with the threads of the rod 30. In this configuration the sleeve bearing 40 is moved up and down along the rod 30 as the rod 30 is rotated by operation of the motor 36. Further, the sleeve bearing 40 may be coupled to the top wall 26 of the primary lift panel 20 so that the primary lift panel 20 is correspondingly moved upwardly or downwardly by movement of the sleeve bearing 40 and rotation of the rod 30 when energized.

The framework 12 includes a back panel 16 extending upwardly from the bottom wall 14 and positioned parallel to the primary lift panel 20 (but not coupled to the primary lift panel 20. The interior wall 24 of the primary lift panel 20 includes at least one (and preferably two) alignment panel 25 extending outwardly from the interior wall 24. Correspondingly, the back panel 16 defines at least one (but preferably two) alignment channel 18 extending between a bottom and top of the back panel 16, the alignment channel 18 configured to receive the alignment panel 25 of the interior wall 24 of the primary lift panel 20 so that the primary lift panel 20 is aligned and stable when moving up or down along the rod 30 as described herein.

Figure 2:
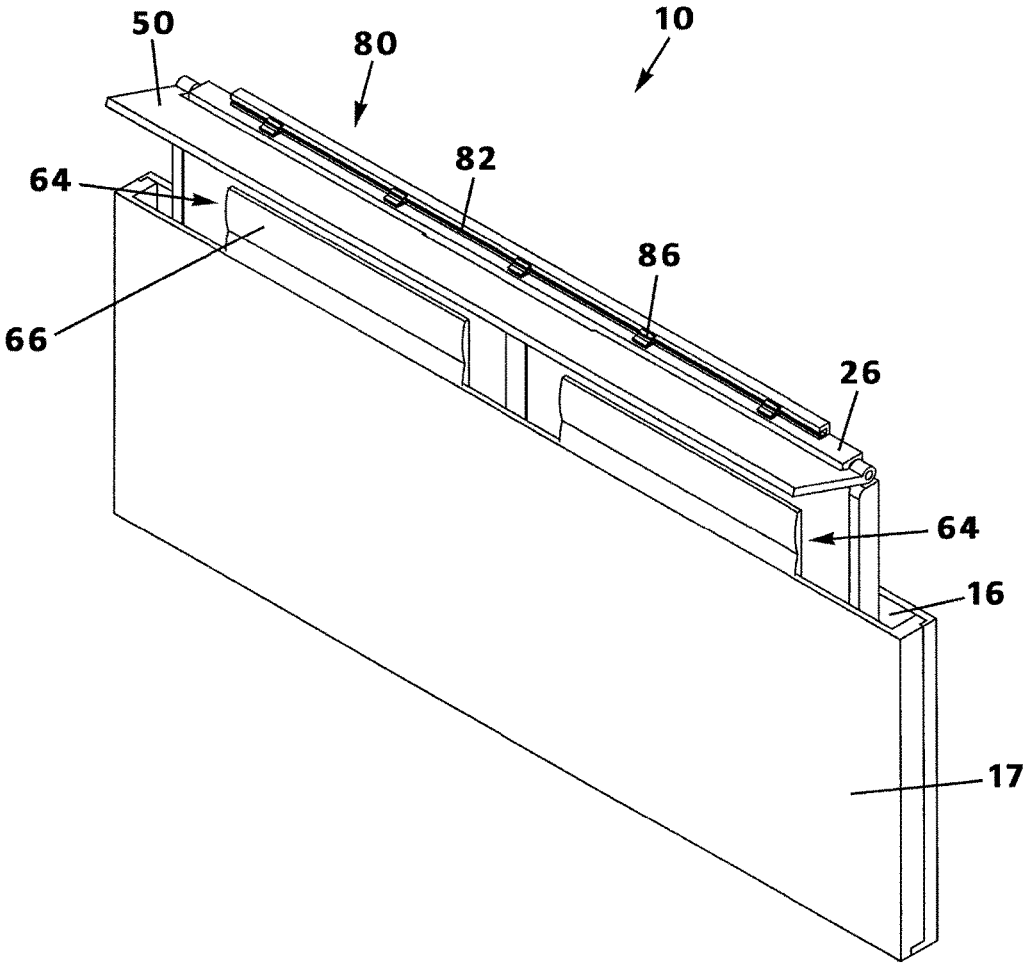
FIG. 2 is a perspective view of the bedding lifting apparatus as in FIG. 1 illustrated with the primary lift panel in a raised configuration.
Figure 3:
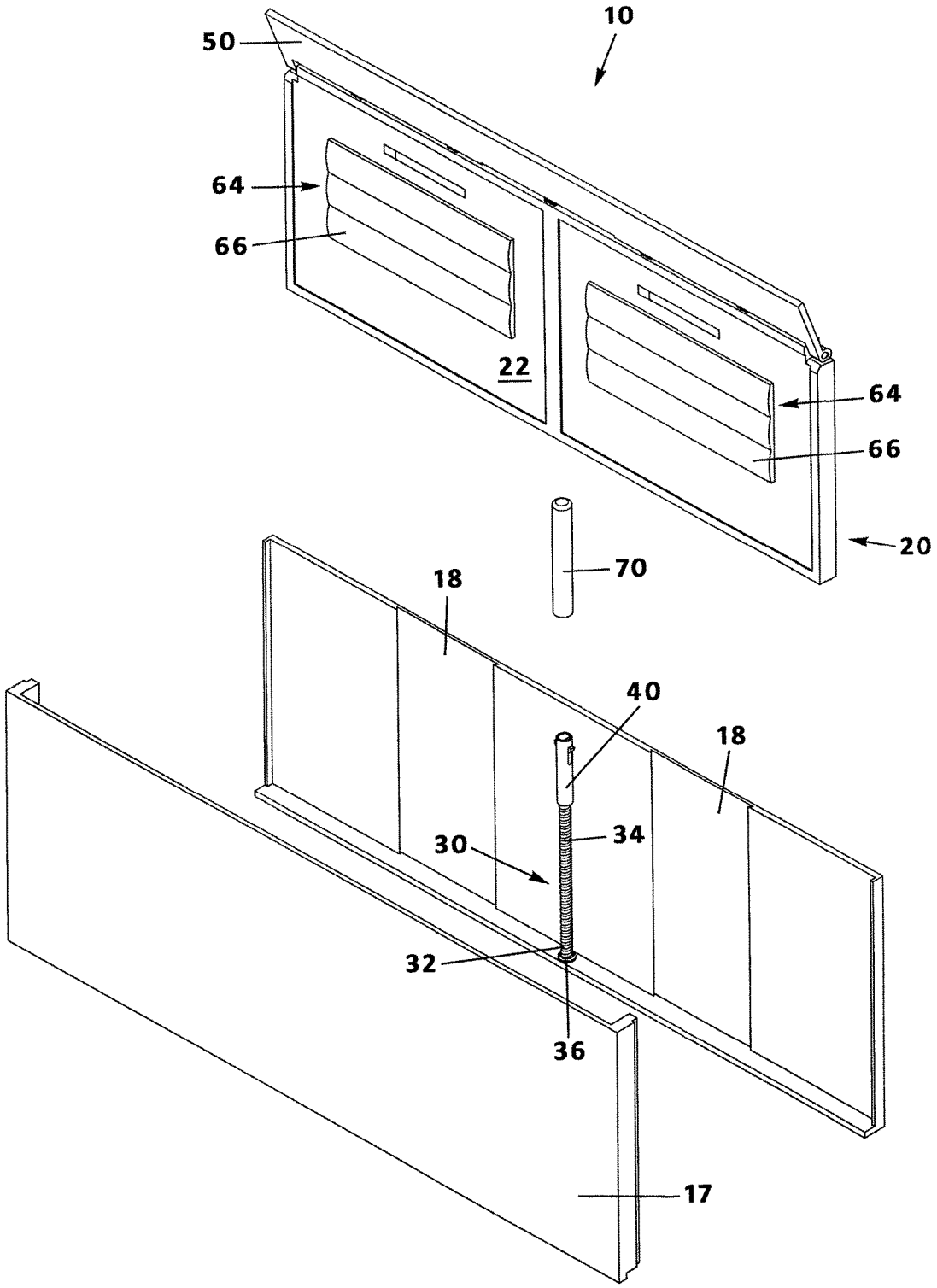
FIG. 3 is an exploded view of the bedding lifting apparatus as in FIG. 1.
Figure 4A:
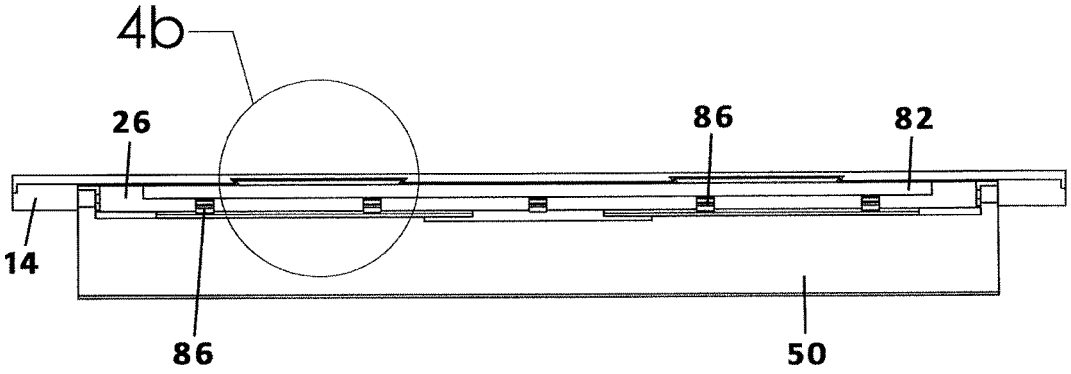
FIG. 4*a* is a top view of the bedding lifting apparatus as in FIG. 1, the front panel being removed from this and subsequent figures for sake of clarity.
Figure 4B:
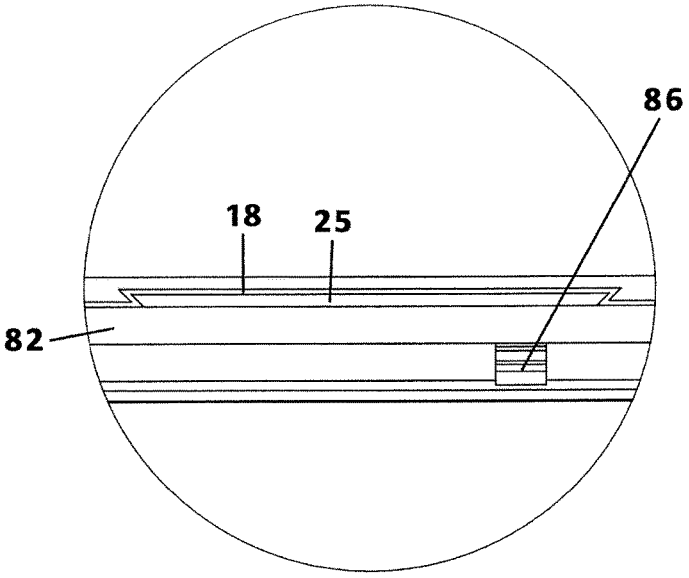
FIG. 4*b* is an isolated view on an enlarged scale taken from FIG. 4*a;*
Figure 5:
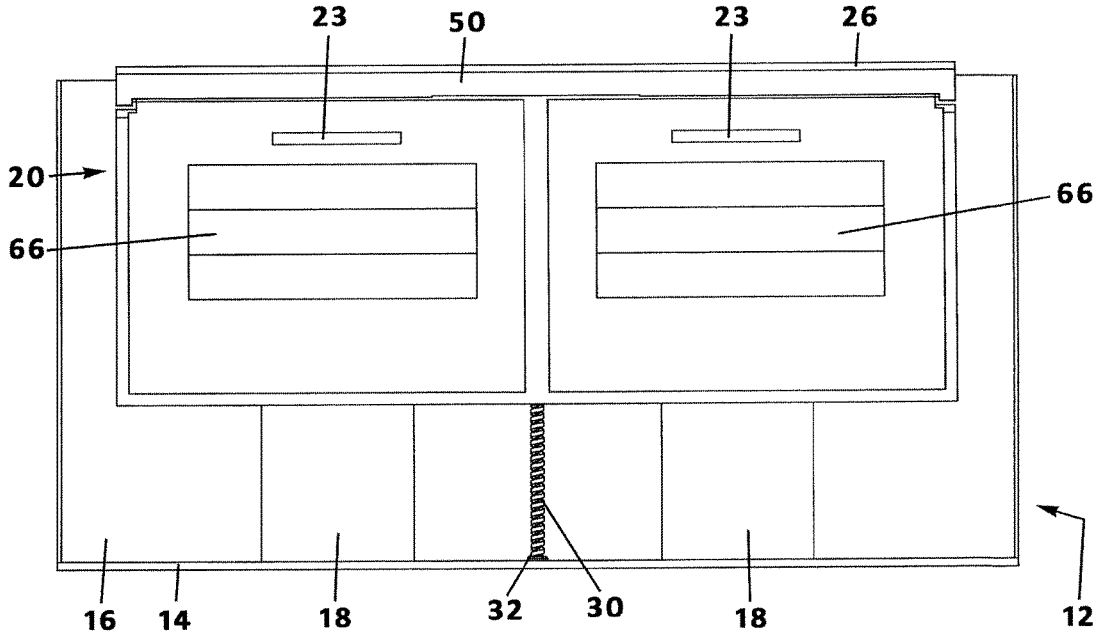
FIG. 5 is a front view of the bedding lifting apparatus as in FIG. 2.

In a structure substantially similar to that of the back panel 16 and as shown FIGS. 1 to 3, the framework 12 may include a front panel 17 extending upwardly from the bottom wall 14 and positioned parallel to the primary lift panel 20 (but not coupled to the primary lift panel 20). Preferably, the back panel 16 is coupled to the front panel 17 so as to form a housing or casing around the primary lift panel 20. In other words, the primary lift panel 20 is situated between the front and back panels. The primary lift panel 20 may have the same height as an upper edge of the back and front panels, respectively, when the primary lift panel 20 is not lifted, but then the primary lift panel 20 extends upwardly above the back and front panels when the rod is actuated as described above. To be clear, the primary lift panel 20 is movable in vertical directions whereas the back 16 and front 17 panels are not movable. The front panel 17 is shown only in FIGS. 1 to 3 and removed from subsequent drawings for sake of clarity.

In another aspect, an auxiliary lift panel 50 may be coupled to (or proximate to opposed ends of the top wall 26 of the primary lift panel 20. The auxiliary lift panel 50 has a generally flat or planar configuration and is pivotally movable between a stowed configuration that is parallel to the primary lift panel (extends downwardly toward the primary lift panel 20 as shown in FIG. 1) and a deployed configuration extending away from the primary lift panel 20 in the direction of the bed (i.e. generally perpendicular to the exterior side of the primary lift panel 20) (FIG. 2). The auxiliary lift panel 50 may be electrically connected to an auxiliary motor 52 for moving the auxiliary lift panel 50 between the configurations discussed above. The auxiliary motor 52 may also be referred to as a rotary motor. The auxiliary motor 52 may also be controlled via remote control 92 or other input device. It is understood that in addition to control via the remote control 92, the auxiliary lift panel 50 may be pushed down from the deployed configuration to the stowed configuration with manual downward pressure, e.g. with a person's fingers.

In another aspect, the blanket lifting apparatus includes a heating element 60 positioned in the interior space of the primary lift panel 20 and is configured to generate heated air when energized, such as by the battery or other power source 92. In an embodiment, the heating element 60 may be an electric heating coil, resistance heater, radiant or infrared heater, ceramic heating element, or the like. It is understood that the apparatus may be configured to produce and circulate cool air and not heated air only. The exterior wall 22 of the primary lift panel 20 defines an air outlet 23 through which heated air generated by the heating element 60 may pass when the heating element 60 is selectively energized. In an embodiment, a fan assembly 62 may be situated in the interior space of the primary lift panel 20 intermediate the heating element 60 and the air outlet 23. When energized, the blower assembly 62 draws and pushes the heated air from the heating element 60 through the air outlet 23 and, in an embodiment, to the massaging device 64. And, as discussed above, the primary lift panel 20 includes an air inlet 27 configured so that fresh air is drawn into the interior space, such as to be heated or cooled as described above.

Similarly, the blanket lifting apparatus 10 may include a foot massaging device 64 positioned in the interior space of the primary lift panel 20. More particularly, the foot massaging device 64 may be mounted to the exterior wall 22 of the primary lift panel 20 and may include at least one padded surface 66 against which a user lying on the mattress of the bed may press his foot. The massaging device 64 may include a padded sleeve defining an interior area. Further, a plurality of rollers 68 may be positioned inside the padded sleeve and configured to vibrate or oscillate when energized, so as to provide massaging action to a user's feet. In an alternative embodiment, electronic pulse or other oscillating technology may be implemented rather than traditional rollers. In various embodiments and implementations, the at least one padded surface may include or interchanged with medicated pads, light emitting diodes (LEDs), and otherwise configured to implement infrared therapy for a user's feet. It is understood that all of the electronics or electrical components described herein may be housed in an electronics box 94 situated in the primary lift panel 20.

Figure 6A:
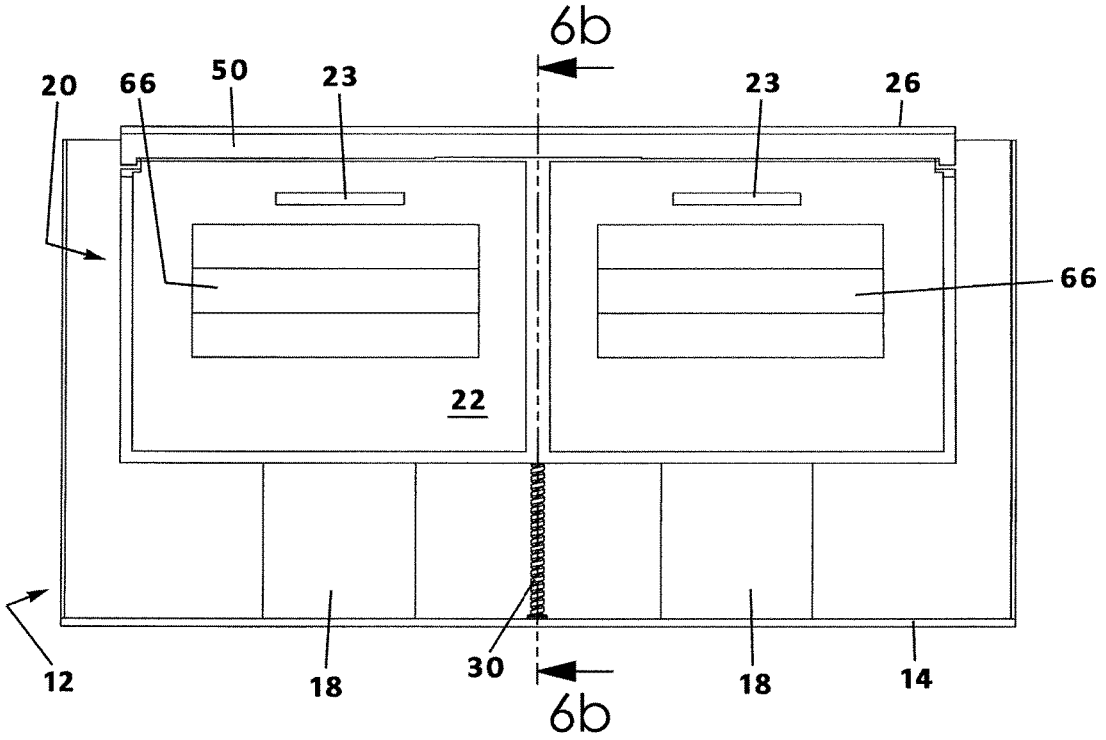
FIG. 6*a* is another front view of the bedding lifting apparatus as in FIG. 2.
Figure 6B:
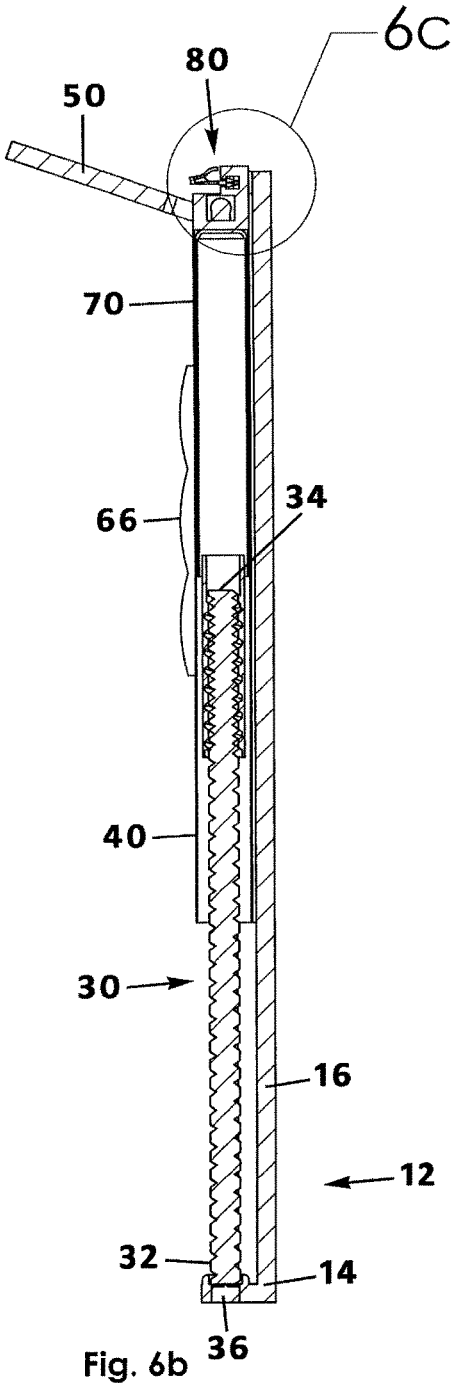
FIG. 6*b* is a sectional view taken along line 6*b*-6*b* of FIG. 6*a;*
Figure 6C:
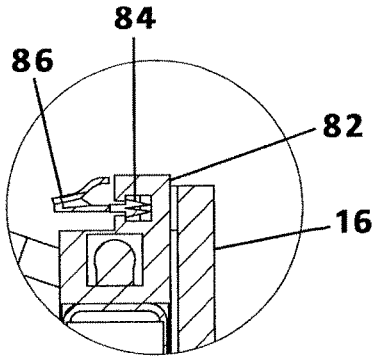
FIG. 6*c* is an isolated view on an enlarged scale taken from FIG. 6*b;*
Figure 7A:
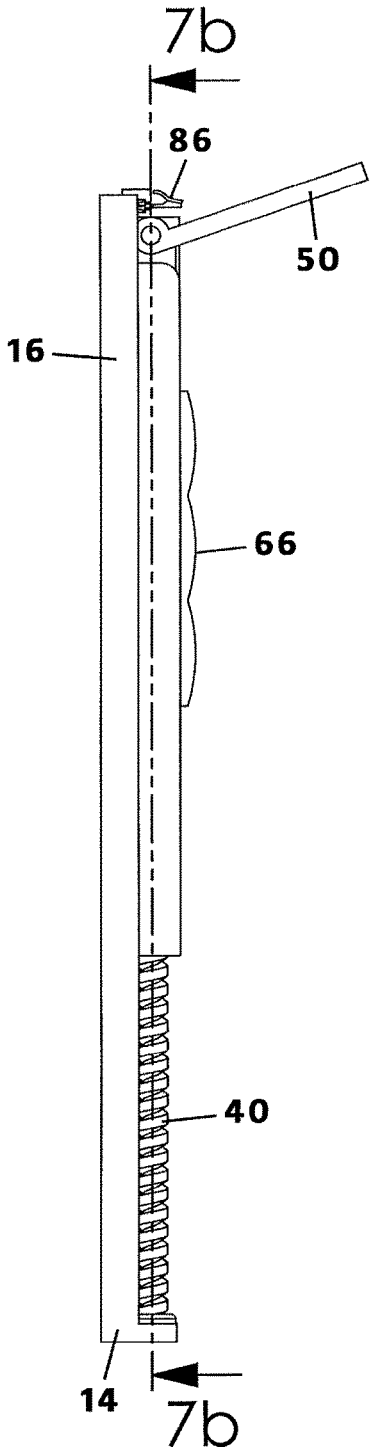
FIG. 7*a* is a side view of the bedding lifting apparatus as in FIG. 2.
Figure 7B:
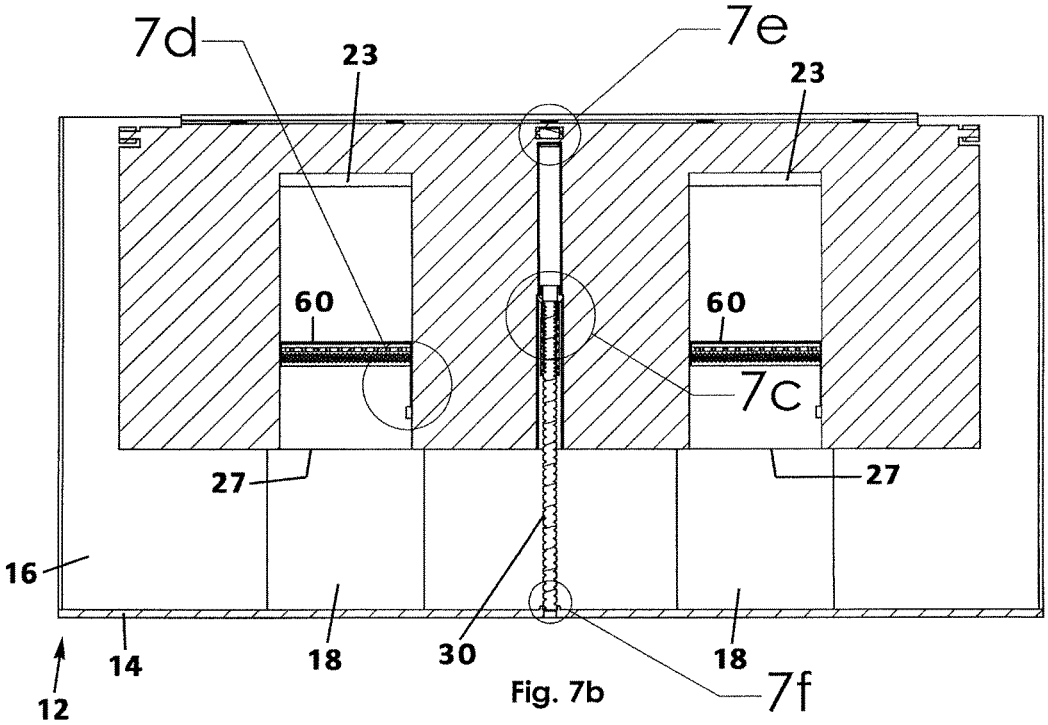
FIG. 7*b* is a sectional view taken along line 7*b*-7*b* of FIG. 7*a;*
Figure 7C:
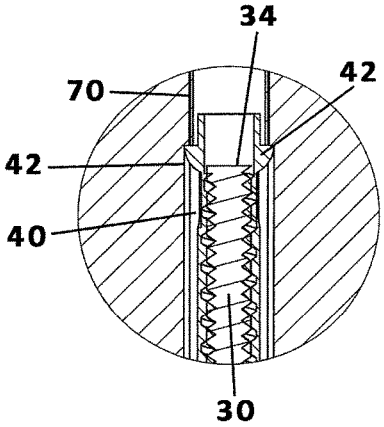
FIG. 7*c* is an isolated view on an enlarged scale taken from FIG. 7*b;*
Figure 7D:
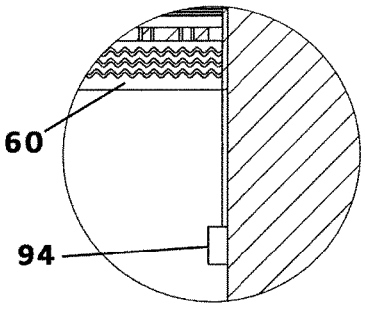
FIG. 7*d* is an isolated view on an enlarged scale taken from FIG. 7*b;*
Figure 7E:
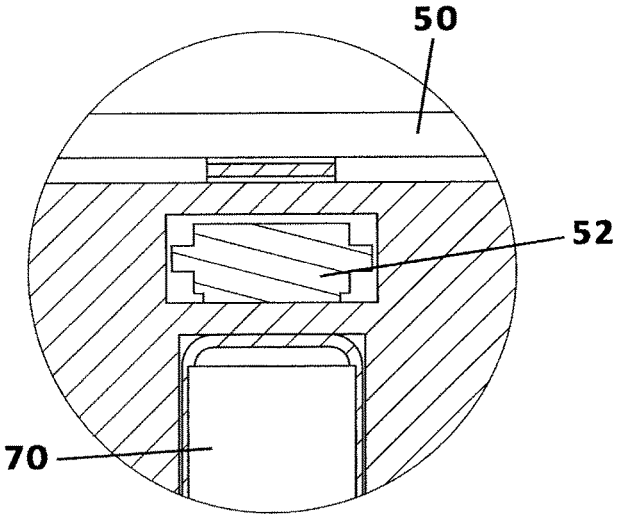
FIG. 7*e* is an isolated view on an enlarged scale taken from FIG. 7*b;*
Figure 7F:
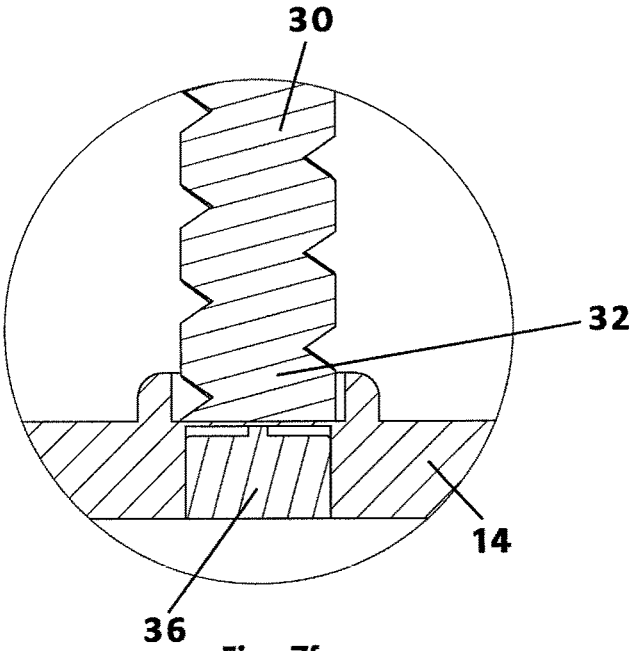
FIG. 7*f* is an isolated view on an enlarged scale taken from FIG. 7*b;*
Figure 8A:
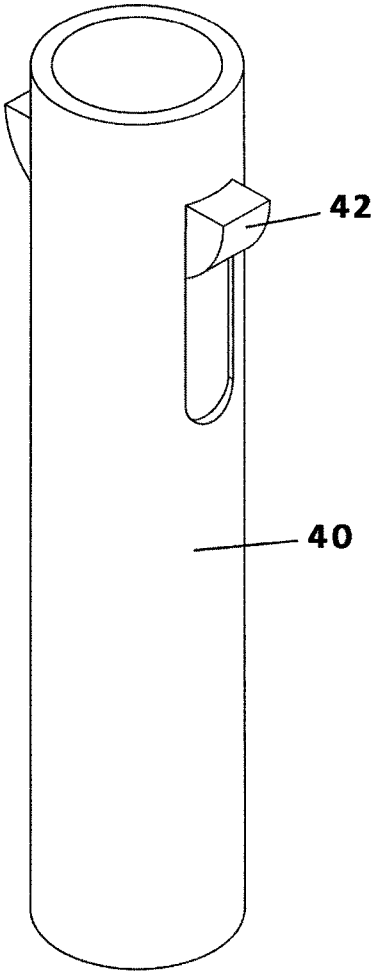
FIG. 8*a* is a perspective view of a sleeve bearing removed from the apparatus for clarity and illustrated with a pressure activated stop member in an extended configuration.
Figure 8B:
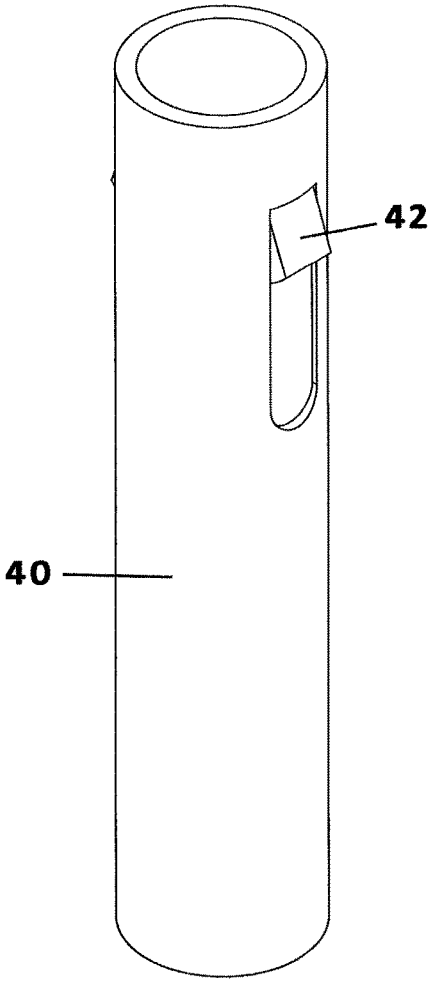
FIG. 8*b* is a perspective view of the sleeve bearing as in FIG. 8*a* and illustrated with the pressure activated stop member in a retracted configuration.
Figure 9A:
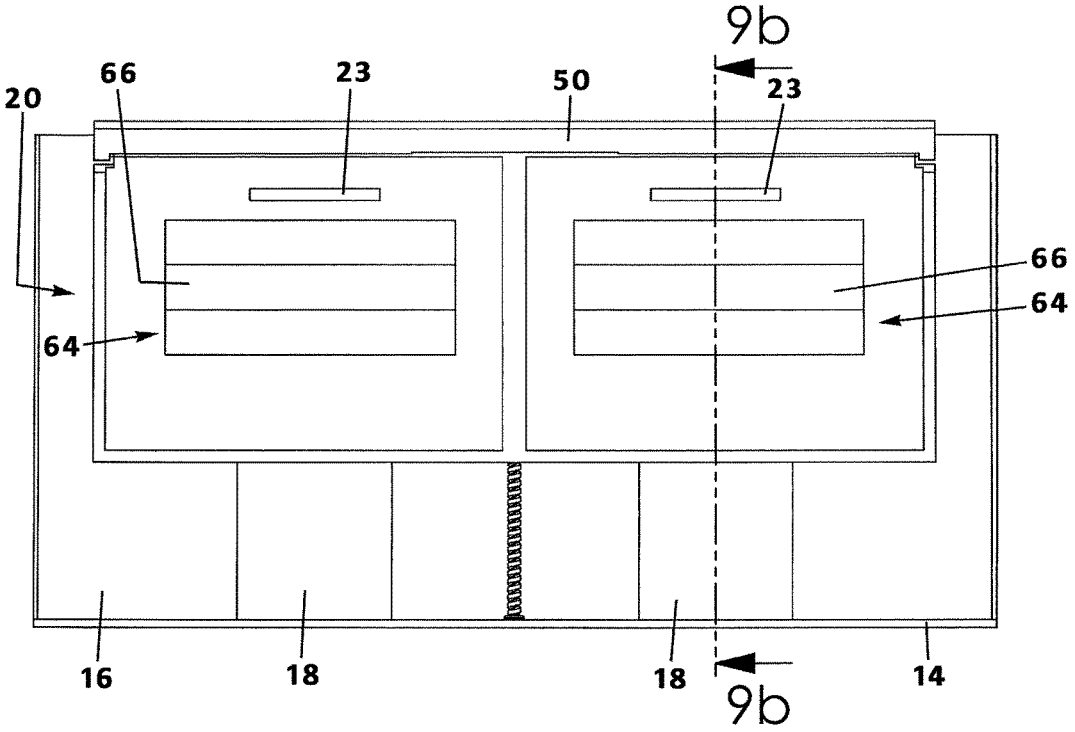
FIG. 9*a* is another perspective view of the bedding lifting apparatus as in FIG. 2.
Figure 9B:
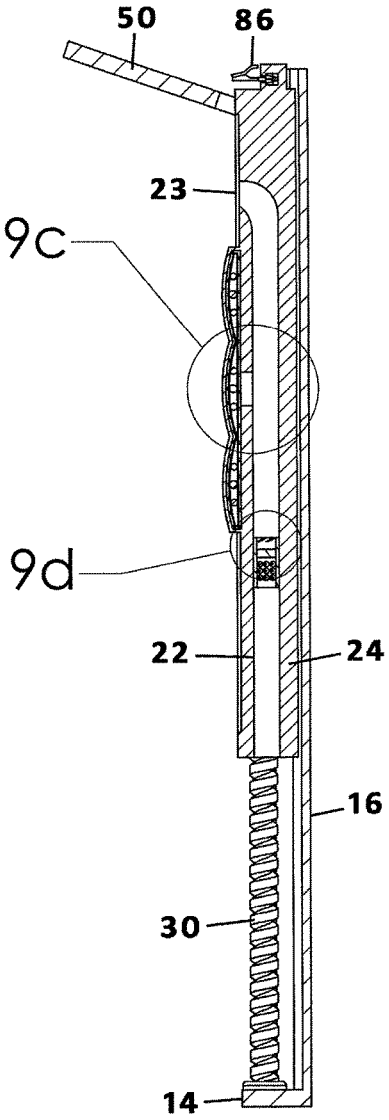
FIG. 9*b* is a sectional view taken along line 9*b*-9*b* of FIG. 9*a;*
Figure 9C:
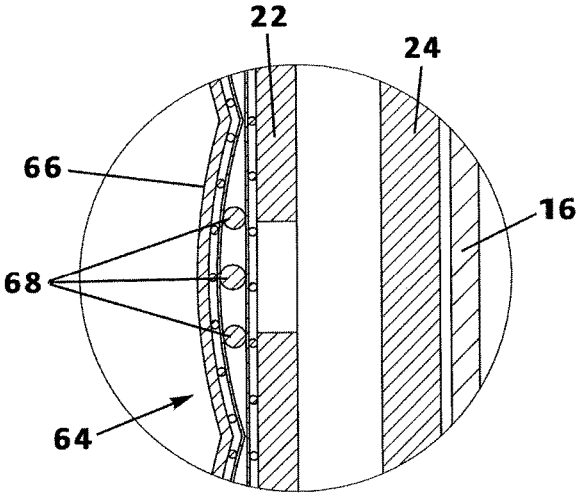
FIG. 9*c* is an isolated view on an enlarged scale taken from FIG. 9*b;*
Figure 9D:
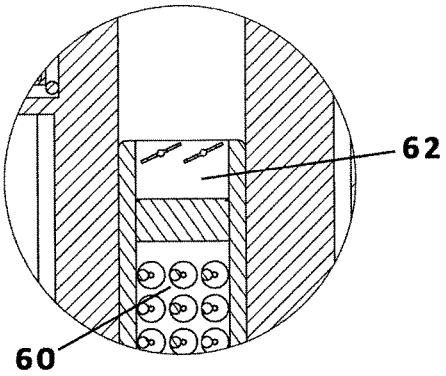
FIG. 9*d* is an isolated view on an enlarged scale taken from FIG. 9*b*.
Figure 10:
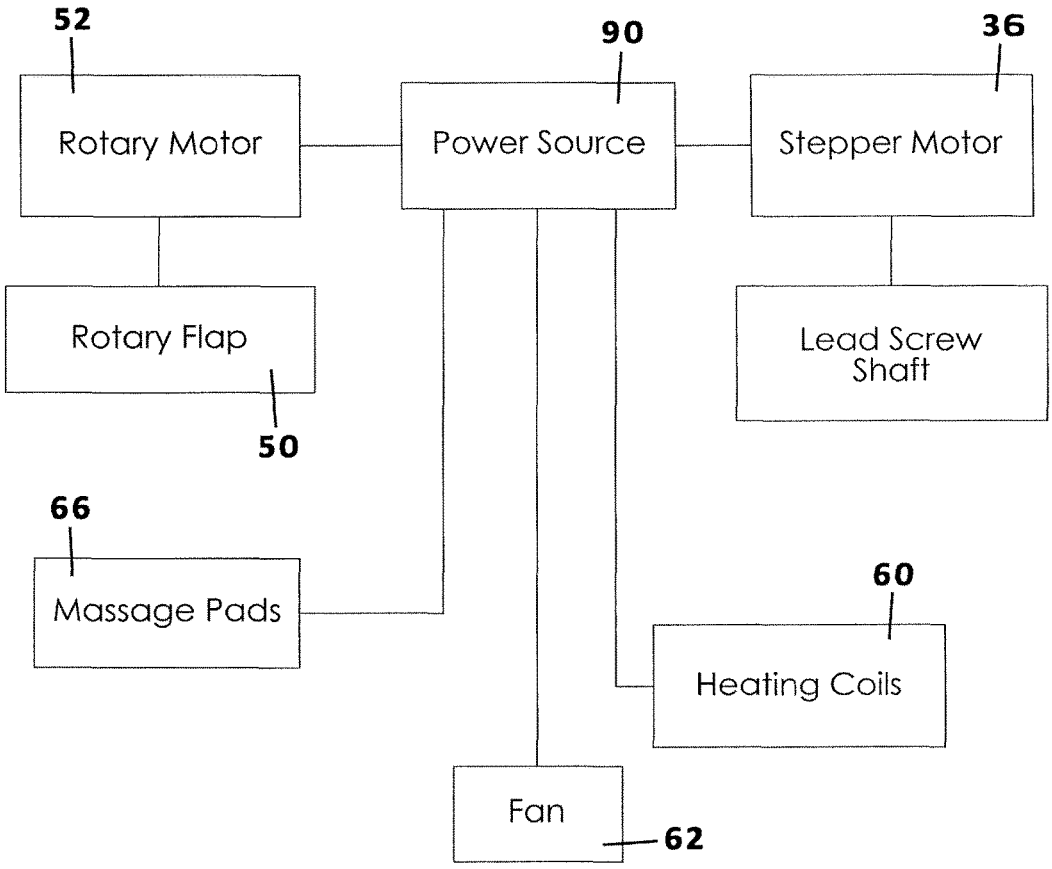
FIG. 10 is a block diagram illustrating the electronic components according to the present invention.

In another aspect specifically designed for a user's safety, the blanket lifting apparatus 10 includes a collapse casing 70 having a first end positioned adjacent to an upper end of the sleeve bearing 40 and a second end coupled to the top wall 26 of the primary lift panel 20 (FIGS. 6*b*, 8*a*, and 8*b*). The collapse casing 70 includes a cylindrical configuration and is situated intermediate the distal end of the rod 30 and the top wall 26 of the primary lift panel 20. Preferably, the collapse casing 70 has a diameter that is larger than a diameter of the sleeve bearing 40 so that it may collapse to surround the sleeve bearing 40 as described below.

Further, the sleeve bearing 40 includes a pair of pressure activated stop members 42 adjacent an upper end thereof which are movable between an extended configuration that supports the collapse casing 70 atop the sleeve bearing 40 and a retracted configuration which allows the collapse casing 70 to drop instantly to a collapsed configuration surrounding the sleeve bearing 40. The pair of pressure activated stop members 42 moves from the extended configuration to the collapsed configuration when a predetermined weight load is experienced and exceeded. In use, if a person inadvertently falls atop the primary lift panel 20 and upstanding rod 30, the stop members 42 will experience the predetermined load thereupon and will move immediately to the retracted configuration within the sleeve bearing 40. With the stop members 42 retracted, the collapse casing 70 drops immediately around the sleeve bearing 40 and the primary lift panel 20 move downward to its stowed configuration. The immediate downward movement, or "collapse," is intended to alleviate or minimize any injury to the user.

The blanket lifting apparatus 10 includes a bedding fastener assembly 80 coupled to the top wall 26 of the primary lift panel 20 and is configured for selectively retaining a portion of the bedding lying atop the mattress such that the bedding is raised or lowered vertically corresponding to respective movements of the primary lift panel 20 as described above. In an embodiment, the bedding fastener assembly 80 includes a rail 82 mounted atop the top wall 26 of the primary lift panel 20, the rail 82 having an elongate linear configuration. Further, the rail 82 may define a channel 84 that extends substantially between opposed ends of the rail 82. The bedding fastener assembly 80 may also include a plurality of spring clips 86, each spring clip 86 being removably and selectively inserted into the channel 84 of the rail 82 in a mild friction fit arrangement (so as to be easily inserted or removed). Each spring clip 86 is laterally slidable in the channel 84 so as to be equally spaced apart as desired by a user. Each spring clip 86 may include jaws facing toward the bed into which a blanket or sheet may be inserted and held while the primary lift panel 20 is raised or lowered as described above.

In use, the framework 12 may be situated between the mattress and the footboard of a bed. It is understood the blanket lifting apparatus 10 may include additional structures for being mounted and secured to a bed frame than are described above. When not in use, the primary lift panel 20 is in the stowed or down configuration (FIG. 1). But when a user is ready for bed, the rod 30 may be energized, such as with a remote control device 92, so as to raise the primary lift panel 20 as described above. Optionally, the auxiliary lift panel 50 may be energized to raise the blanket or just to give more support and to put less strain on the bedding fastener assembly 80. The remote control 92 may also be used to activate the heating element 60 and massage device 64.

It is understood that while certain forms of this invention have been illustrated and described, it is not limited thereto except insofar as such limitations are included in the following claims and allowable functional equivalents thereof.

The invention claimed is:

1. A blanket lifting apparatus for use with a bed for selectively raising bedding that is lying atop a mattress of a bed such that the bedding is raised above the feet of a person lying on the mattress, said blanket lifting apparatus comprising:

a framework that includes a bottom wall having an elongate configuration;

a rod having a proximal end operatively coupled to said bottom wall and having a threaded configuration, said rod extending upwardly from said bottom wall to a distal end opposed to said proximal end;

a motor operatively coupled to said rod that actuates said rod to rotate when energized;

a primary lift panel operatively coupled to said rod such that said primary lift panel is moved upwardly when said rod is actuated to rotate in a first direction;

wherein said primary lift panel is perpendicular to and moves vertically relative to said bottom wall; and a bedding fastener assembly coupled to a top wall of said primary lift panel for selectively retaining the bedding such that the bedding is moved vertically according to movement of said primary lift panel.

2. The blanket lifting apparatus as in claim 1, further comprising a sleeve bearing having a tubular configuration and bearing threads on an inner surface thereof that are complementary to and engaged with the threaded configuration of said rod, said sleeve bearing being coupled to said primary lift panel such that said sleeve bearing and said primary lift panel are moved vertically when said rod is actuated to rotate.

3. The blanket lifting apparatus as in claim 1, further comprising:

an auxiliary lift panel pivotally coupled to opposed ends of said top wall, said auxiliary lift panel being movable between a stowed configuration extending downwardly toward said primary lift panel and a deployed configuration extending away from said primary lift panel in the direction of the bed; and an auxiliary motor electrically connected to said auxiliary lift panel for moving said auxiliary lift panel to said deployed configuration when energized.

4. The blanket lifting apparatus as in claim 1, wherein:

said primary lift panel includes an interior wall having at least one alignment panel extending outwardly from said interior wall;

said primary lift panel includes an exterior wall parallel to and spaced apart from said interior wall that, together, define an interior space;

said rod extending upwardly in said interior space of said primary lift panel.

5. The blanket lifting apparatus as in claim 4, wherein said framework includes:

a back panel having a planar configuration and extending upwardly from said bottom wall, said back panel being parallel to said primary lift panel;

a front panel having a planar configuration and extending upwardly from said bottom wall, said front panel being parallel to said primary lift panel;

said primary lift panel is situated between said back panel and said front panel and configured to move vertically relative to said back panel and said front panel when said rod is actuated.

6. The blanket lifting apparatus as in claim 5, wherein said back panel includes an inner surface that defines at least one recessed channel extending between said bottom wall of said framework and an upper edge of said back panel, said at least one recessed channel receiving said at least one alignment panel such that said primary lift panel is slidably aligned with said back panel.

7. The blanket lifting apparatus as in claim 4, further comprising:

a heating element positioned in said interior space of said primary lift panel for generating heated air when energized;

wherein said exterior wall of said primary lift panel defines an air outlet, wherein said generated heated air is passed through said air outlet when said heating element is energized.

8. The blanket lifting apparatus as in claim 7, further comprising a fan assembly situated intermediate said heating element and said air outlet, said fan assembly having a blower for urging said generated heated air through said air outlet when energized.

9. The blanket lifting apparatus as in claim 7, wherein a lower wall of said primary lift panel defines at least one air inlet in communication with said interior space so that fresh air is drawn into said interior space to be heated by said heating element when energized.

10. The blanket lifting apparatus as in claim 2, further comprising a collapse casing having a first end positioned adjacent to an upper end of said sleeve bearing and a second end coupled to said top wall of said primary lift panel, said collapse casing being situated intermediate said distal end of said rod and said top wall;

wherein said sleeve bearing includes a pair of pressure activated stop members adjacent an upper end thereof which are movable between an extended configuration that supports said collapse casing atop said sleeve bearing and a retracted configuration which allows said collapse casing to drop instantly to a collapsed configuration surrounding said sleeve bearing;

wherein said pair of pressure activated stop members moves from said extended configuration to said collapsed configuration when a predetermined weight load is experienced.

11. The blanket lifting apparatus as in claim 10, wherein said collapse casing has a diameter that is larger than a diameter of said sleeve bearing such that said collapse casing receives said sleeve bearing concentrically therein at said collapsed configuration.

12. The blanket lifting apparatus as in claim 1, further comprising a foot massaging device mounted to an exterior wall of said primary lift panel, said foot massaging device including a padded surface that vibrates when energized.

13. The blanket lifting apparatus as in claim 12, wherein said foot massaging device includes a plurality of rollers spaced apart within at least one padded sleeve.

14. The blanket lifting apparatus as in claim 1, wherein said bedding fastener assembly includes:

a rail mounted atop said primary lift panel and having an elongate configuration;

a plurality of clips coupled to said rail that selectively retain the bedding such that the bedding is moved vertically according to movement of said primary lift panel.

15. The blanket lifting apparatus as in claim 14, wherein:

said rail defines a channel that is open in a direction toward the bed;

said plurality of clips are slidably retained in said channel in a friction fit arrangement, each clip being selectively removably inserted in said channel and slidably spaced apart from an adjacent clip.

16. A blanket lifting apparatus for raising bedding that is lying atop a mattress of a bed such that the bedding is raised above the feet of a person lying on the mattress, said blanket lifting apparatus, comprising:

a rod that is threaded having a proximal end rotatably coupled to a bottom wall of a framework, said rod extending upwardly from said bottom wall to a distal end opposed to said proximal end;

a motor operatively coupled to said proximal end of said rod and which actuates said rod to rotate when energized;

a primary lift panel operatively coupled to said rod such that said primary lift panel is moved upwardly when said rod is actuated to rotate in a first direction and such that said primary lift panel is moved downwardly when said rod is actuated to rotate in a second direction;

wherein said primary lift panel is perpendicular to and moves vertically relative to said bottom wall; and a plurality of spring clips mounted to a top wall of said primary lift panel for selectively retaining the bedding such that the bedding is moved vertically according to movement of said primary lift panel;

an auxiliary lift panel pivotally coupled to opposed ends of said top wall, said auxiliary lift panel being movable between a stowed configuration generally parallel to said primary lift panel and a deployed configuration extending away from said primary lift panel in the direction of the bed; and an auxiliary motor electrically connected to said auxiliary lift panel for moving said auxiliary lift panel to said deployed configuration when energized.

17. The blanket lifting apparatus as in claim 16, further comprising a sleeve bearing having a tubular configuration and having bearing threads on an inner surface thereof that are complementary and engaged with said threaded configuration of said rod, said sleeve bearing being coupled to said primary lift panel such that said sleeve bearing and said primary lift panel are moved vertically when said rod is actuated to rotate.

18. The blanket lifting apparatus as in claim 16, further comprising a collapse casing having a first end positioned adjacent an upper end of said sleeve bearing and a second end coupled to said top wall of said primary lift panel, said collapse casing being situated intermediate said distal end of said rod and said top wall;

wherein said sleeve bearing includes a pair of pressure activated stop members adjacent an upper end thereof which are movable between an extended configuration that supports said collapse casing atop said sleeve bearing and a retracted configuration which allows said collapse casing to drop instantly to a collapsed configuration surrounding said sleeve bearing;

wherein said pair of pressure activated stop members moves from said extended configuration to said collapsed configuration when a predetermined weight load is experienced.

19. The blanket lifting apparatus as in claim 18, wherein said collapse casing has a diameter that is larger than a diameter of said sleeve bearing such that said collapse casing receives said sleeve bearing concentrically therein at said collapsed configuration.

20. The blanket lifting apparatus as in claim 16, wherein:

said primary lift panel includes an interior wall having at least one alignment panel extending outwardly from said interior wall;

said primary lift panel includes an exterior wall parallel to and spaced apart from said interior wall that, together, define an interior space;

said rod extending upwardly in said interior space of said primary lift panel;

said framework includes a back panel having a planar configuration and extending upwardly from said bottom wall, said back panel being parallel to said primary lift panel;

said back panel includes an inner surface that defines at least one recessed channel extending between said bottom wall of said framework and an upper edge of said back panel, said at least one recessed channel receiving said at least one alignment panel such that said primary lift panel is slidably aligned with said back panel.

21. The blanket lifting apparatus as in claim 20, further comprising:

a heating element positioned in said interior space of said primary lift panel for generating heated air when energized;

wherein said exterior wall of said primary lift panel defines an air outlet, wherein said generated heated air is passed through said air outlet when said heating element is energized.

22. The blanket lifting apparatus as in claim 21, further comprising a fan assembly situated intermediate said heating element and said air outlet, said fan assembly having a blower for urging said generated heated air through said air outlet when energized.

23. The blanket lifting apparatus as in claim 21, further comprising a foot massaging device mounted to said primary lift panel, said foot massaging device including a padded surface that vibrates when energized.

24. The blanket lifting apparatus as in claim 16, further comprising:

a rail having an elongate linear configuration that defines a channel that is open in a direction toward the bed;

wherein said plurality of spring clips are slidably retained in said channel in a friction fit arrangement, each spring clip being selectively and removably inserted in said channel and slidably spaced apart from an adjacent clip.

* * * * *